US007535439B2

(12) United States Patent
Nitta et al.

(10) Patent No.: US 7,535,439 B2
(45) Date of Patent: May 19, 2009

(54) DISPLAY DEVICE AND METHOD FOR DRIVING A DISPLAY DEVICE

(75) Inventors: Hiroyuki Nitta, Fujisawa (JP); Masahisa Tsukahara, Fujisawa (JP); Toshifumi Ozaki, Koganei (JP)

(73) Assignee: Hitachi Displays, Ltd., Chiba (JP)

( * ) Notice: Subject to any disclaimer, the term of this patent is extended or adjusted under 35 U.S.C. 154(b) by 610 days.

(21) Appl. No.: 11/433,775

(22) Filed: May 15, 2006

(65) Prior Publication Data

US 2006/0273993 A1 Dec. 7, 2006

(30) Foreign Application Priority Data

Jun. 3, 2005 (JP) ..... 2005-164411
Mar. 23, 2006 (JP) ..... 2006-081757

(51) Int. Cl.
*G09G 3/20* (2006.01)

(52) U.S. Cl. ..... 345/75.2; 345/204; 345/75.1; 345/74.1

(58) Field of Classification Search ..... 345/75.2, 345/75.1, 74.1, 204; 315/169.1–169.3
See application file for complete search history.

(56) References Cited

U.S. PATENT DOCUMENTS

2002/0027551 A1* 3/2002 Nitta et al. ..... 345/204
2003/0025687 A1* 2/2003 Shino et al. ..... 345/204
2004/0001039 A1 1/2004 Shino et al.

* cited by examiner

*Primary Examiner*—Amare Mengistu
*Assistant Examiner*—Insa Sadio
(74) *Attorney, Agent, or Firm*—McDermott Will & Emery LLP

(57) ABSTRACT

A display device driver constructed of scanning selection switches corresponding to a plurality of scanning wiring lines, a non-selection switch which brings the scanning wiring line into a non-selected state, a feedback switch which detects a scanning electrode potential and a negative feedback amplifier which sets the scanning electrode potential to a predetermined potential every electrode based on the scanning electrode potential detected by the feedback switch, and a time constant formed of a combined capacitance of a capacitance of the feedback switch and a wiring line capacitance and a feedback switch resistance is set to be smaller than that of a display panel capacitance and a scanning selection switch resistance.

10 Claims, 7 Drawing Sheets

DISPLAY DEVICE AND METHOD FOR DRIVING A DISPLAY DEVICE

INCORPORATION BY REFERENCE

The present application claims priority from Japanese applications JP2005-164411 filed on Jun. 3, 2005 and JP2006-081757 filed on Mar. 23, 2006, the contents of which are hereby incorporated by reference into this application.

BACKGROUND OF THE INVENTION

The present invention relates to a display device and a method for driving the display device, more particularly to a display device using a multielectron source in which electron emission elements are arranged in a matrix form, and a method for driving the display device.

Much attention has been attracted on a self-luminous, matrix-type display in which electron sources are provided at intersections between electrode groups perpendicular to each other, and applied voltage or applied time to respective electron sources are adjusted, thereby the quantity of electrons emitted from the electron sources are controlled, and then the emitted electrons are accelerated by high voltage and thus irradiated to phosphors.

As the electron sources for use in this type of display, there are an electron source using a field emission type cathode, a thin-film electron source, an electron source using a carbon nano-tube, an electron source using a surface conduction electron emission element, or the like. This type of display panel generally performs line-sequential scanning.

In U.S. Patent Publication 2004/0001039 (JP-A-2004-86130), there is described a display device including a correction circuit which corrects a voltage variance of a row selection signal due to a voltage drop generated by an on-resistance of an output stage of a row driving circuit and a current flowing through a wiring line of a selected row in accordance with gray-scale information; and a column driving circuit which generates a modulation signal modulated in accordance with the gradation information so as to suppress a rapid change of the current flowing through the wiring line of the selected row.

SUMMARY OF THE INVENTION

In a self-luminous emission type matrix display in which each electron source is disposed in an intersection between a scanning wiring line and a data wiring line crossing each other at right angles, an operation of selecting the scanning wiring line is performed using a switching element in a scanning electrode driving circuit. In this switching element, a driving current flows through a pixel connected to the selected scanning wiring line, and reaches several hundreds milliamperes to several amperes.

Therefore, it is not possible to ignore a voltage drop caused by an on-resistance value of the switching element. The current flowing through the switching element changes depending on the image contents. The brighter a screen is, the larger the voltage drop becomes. At this time, a scanning electrode potential is not constant, and a luminance difference referred to as smear is generated in a horizontal direction. The larger the on-resistance of the switching element is, the larger an amount of generated smear becomes.

As a method of reforming the smear, there have been proposed: a method where the level of voltage drop is previously calculated based on image data, and the data-electrode drive circuit is used for correction, or a method where a negative feedback amplifier is used to monitor the scan electrode potential, and applied voltage to the switch element is corrected such that the scan electrode potential is equal to a predetermined potential.

The former method has a problem that gray-scale characteristics of an image are sacrificed. In the latter method, any gray-scale characteristics are not sacrificed, but the negative feedback amplifier is used, and a feedback switch is therefore required for detecting each scan electrode potential to feed the potential back to a feedback terminal of the negative feedback amplifier, in addition to a scanning selection switch.

For example, in the display panel having VGA specification including 480 scanning lines, 480 feedback switches are required for 480 scanning selection switches. It is usually difficult to constitute such circuit by use of individual components, and this circuit is realized by a semiconductor integrated circuit (hereinafter referred to as a large-scale integration (LSI)). However, with such increase of the switches, an LSI chip area also increases, and this results in a cost increase of the LSI.

Here, FIG. 9 shows a structure diagram of a display panel in which electron emission elements are arranged in a matrix form according to the present invention. In FIG. 9, electron emission elements 201 constitute pixels, and the electron emission elements 201 are arranged in the matrix form.

The electron emission elements arranged in a vertical direction are connected to data wiring lines 202, and the electron emission elements arranged in a horizontal direction are connected to scanning wiring lines 203. The display panel is constituted of m horizontal dots and n vertical lines, D1 to Dm denote data electrodes which apply data signals to the data wiring lines, and S1 to Sn denote scanning electrodes which apply selection voltages to the scanning wiring lines. In a case where the line-sequential scanning is performed, there flow, to the selected scanning electrode, all driving currents toward the electron emission elements connected to the selected scanning wiring line.

FIG. 10 shows a constitution of a driver circuit for driving the display panel in which electron emission elements are used. In FIG. 10, an image signal 210 and a synchronous signal 205 are input into a timing controller 206.

The timing controller 206 outputs: a control signal 213 which controls a data electrode driving circuit 207 for driving data electrodes; a control signal 214 which controls a scanning electrode driving circuit 208; and image data 212 which generates driving waveforms to drive the data electrodes.

The scanning electrode driving circuit 208 performs an operation of selecting one scanning wiring line from the scanning wiring lines. One of scanning selection switches SH1 to SHn is turned on, and applies a scanning selection voltage VH from a reference voltage source 4 to the selected scanning electrode. Conversely, a non-selecting operation is performed using non-selection switches SL1 to SLn. A plurality of switches are turned on which correspond to the scanning wiring lines to be brought into a non-selected state, and the switches supply a non-selection voltage VL from a non-selection reference voltage source 8 to the scanning electrode. A high-voltage circuit 211 supplies a high voltage to a display panel 209, and emitted electrons are accelerated by this high voltage and then irradiate to phosphors.

FIG. 11 is an operation waveform diagram of the driving circuit shown in FIG. 10. In the line-sequential scan, at the beginning of vertical scan, selection operation is started from a scan line connected to a scan line electrode S1, and then scan is performed sequentially.

The scanning selection switch SH1 is turned on for a time T1, and the first scanning wiring line is selected. At this time, the data electrode driving circuit 207 supplies data voltages Vd11 to Vd1*n* to data wiring lines, respectively.

Next, the scanning selection switch SH2 is turned on for a time T2, and data voltages Vd21 to Vd2*n* are supplied to data wiring lines, respectively. These operations are successively performed to display one field of images.

FIG. 12 shows a relation between a voltage V to be applied across opposite ends of a thin-film electron source and a current I flowing through the thin-film electron source in a case where the thin-film electron source is used as an electron source for use in the display panel. The current I of the thin-film electron source is very small in a region where the applied voltage V is low (V<Vth). When the applied voltage exceeds Vth, the current starts flowing through the thin-film electron source, and the current I of the thin-film electron source exponentially increases with respect to the applied voltage V. Here, Vmax indicates a maximum value of the voltage to be applied to the thin-film electron source. At this time, the current is denoted with Ip. Polarity of the thin-film electron source is defined as polarity with which the current flows at a time when the scanning wiring line voltage is higher than the data wiring line voltage.

FIG. 13 is a circuit constitution diagram of a scanning electrode correction circuit to which a negative feedback amplifier according to the present invention is applied. It is to be noted that in FIG. 13, to facilitate description, only two scanning electrodes 19, 20 are shown among a plurality of scanning electrodes.

In FIG. 13, the reference voltage source 4 is a voltage source which determines a scanning selection voltage, and the voltage is inputted into a non-invering input terminal of an amplifier 7. An output terminal of the amplifier 7 is connected to scanning selection switches 15 and 17 each having an on-resistance Ron1. When the scanning selection switch 15 is turned on, the scanning selection potential is applied to the scanning electrode 19. At this time, the thin-film electron source connected to the scanning electrode 19 is brought into the selected state, leading to light emission. In the next horizontal scanning period, the scanning selection switch 17 is turned on, and the scanning electrode 20 is selected, leading to light emission.

When the scanning electrode 19 is selected, a feedback switch 16 is turned on, the potential of the scanning electrode 19 is returned to an inverting input terminal of the amplifier 7, and a negative feedback operation is performed so that the potential of the scanning electrode 19 is equal to that of the reference voltage source 4.

FIG. 14 is an operation waveform diagram of FIG. 13. In FIG. 14, Vcont1 is a control signal for the scanning selection switch 15 and the feedback switch 16. It is assumed that when the signal indicates a high level, the switches 15, 16 are turned on. Next, when Vcont2 indicates a high level, the scanning selection switch 17 and a feedback switch 18 are turned on.

The data wiring line connected to each electron source usually has a finite resistance value and wiring line capacitance. Moreover, an output resistance exists in the data electrode driving circuit. Therefore, when the gray-scale changes, a waveform exhibits a certain time constant as in Vdata shown in FIG. 14.

Therefore, at the start of a horizontal scanning period in a case where the scanning electrode is driven, a non-selection period (Vcont') during which no scanning electrode is selected is created, and a selection potential is applied to the scanning electrode after the data voltage reaches a predetermined gray-scale voltage. At this time, waveforms Vs1 and Vs2 involving overshooting components as shown in FIG. 14 are produced.

As shown in FIG. 13, the non-selection reference voltage source 8 is connected to non-selection switches 12 and 13. In the non-selection period, the scanning electrode potential is fixed to a non-selection potential.

A switch 14 is a feedback switch disposed to prevent an output voltage of the amplifier 7 from being indefinite in a non-selection period of each scanning selection period or a non-selection period such as a vertical blanking period. This switch fixes the output voltage of the amplifier 7 at a reference voltage.

Moreover, equivalent on-resistances Ron2 also exist in the feedback switches 16 and 18 in the same manner as in the scanning selection switches. Moreover, there exist a wiring line capacitance Cpat of a feedback line and a parasitic capacitance Cst of the feedback switch itself. Therefore, a waveform delay factor is formed.

As viewed from the feedback switch brought into the on-state in this manner, capacitances of other feedback switches brought into an off-state are all connected in parallel. This means that no high-frequency component is returned to the inverting input terminal which is the feedback input of the amplifier 7. This creates a cause of the overshooting components. Furthermore, this generates a disadvantage of an oscillation phenomenon of the amplifier 7.

Moreover, to constitute the feedback switch in the LSI and lower the on-resistance of the switch, a size of the switching element needs to be increased. This results in enlargement of the LSI chip, that is, a cost increase of the LSI.

Accordingly, it is an object of the present invention to realize a scanning electrode application voltage waveform without any overshooting component and achieve a stabilized circuit operation. Another object is to miniaturize a switching element and provide an inexpensive display device whose LSI cost is reduced.

In the present invention, a display device comprises a display panel in which electron emission elements are arranged in a matrix form and which controls a voltage to be applied to each electron emission element and which converges emitted electrons to irradiate to phosphors with the electrons, thereby emitting light, the display panel having scanning wiring lines and data wiring lines; a scanning electrode driving circuit connected to each scanning wiring line; a data electrode driving circuit connected to each data wiring line; and a high-voltage generation circuit which generates a high voltage for converging the emitted electrons and irradiating to phosphors with the electrons, the scanning electrode driving circuit comprising: a plurality of scanning selection switches which select the scanning wiring line to be allowed to emit the light; a plurality of non-selection switches which bring the scanning wiring line prevented from emitting the light into a non-selected state; a scanning electrode potential detection circuit including a plurality of feedback switches which detect potentials of the scanning electrodes, respectively; and a scanning electrode potential correction circuit which sets a scanning electrode potential to a predetermined potential every scanning electrode based on the scanning electrode potential detected by the feedback switch, the scanning electrode potential detection circuit including a feedback switch capacitance and a wiring line capacitance, wherein a time constant formed of an impedance and the capacitance of the feedback switch is set to be smaller than that formed of an impedance of the scanning selection switch and a display panel capacitance. Furthermore, there is disposed the feedback switch having an impedance which is large than that of the scanning selection switch.

As described above, in the present invention, there can be provided an inexpensive display device which realizes a scanning electrode driving waveform without any overshooting component to display a satisfactory image.

Other objects, features and advantages of the invention will become apparent from the following description of the embodiments of the invention taken in conjunction with the accompanying drawings.

DESCRIPTION OF THE EMBODIMENTS

Embodiment 1

Figure 1:
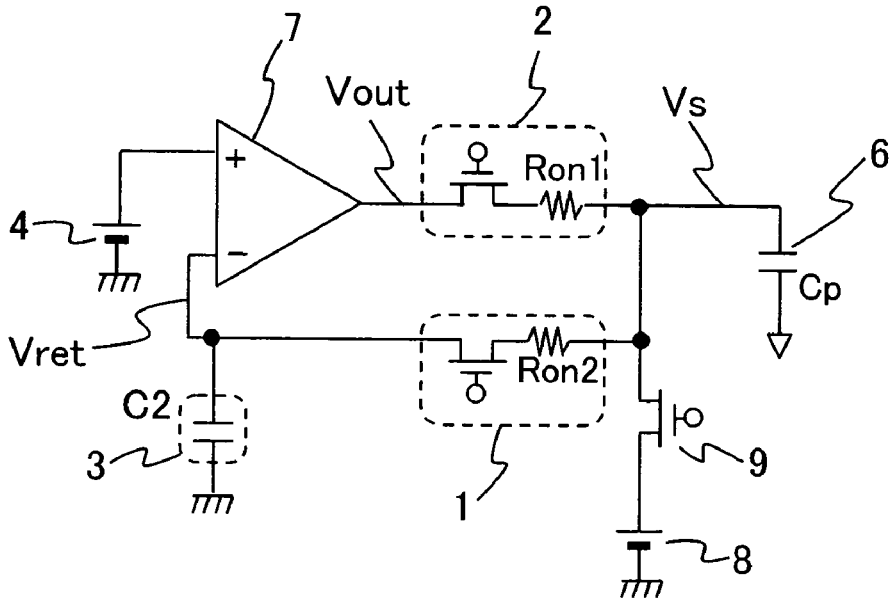
FIG. 1 is a scanning electrode driving circuit diagram of a display device according to the present invention.
Figure 2:
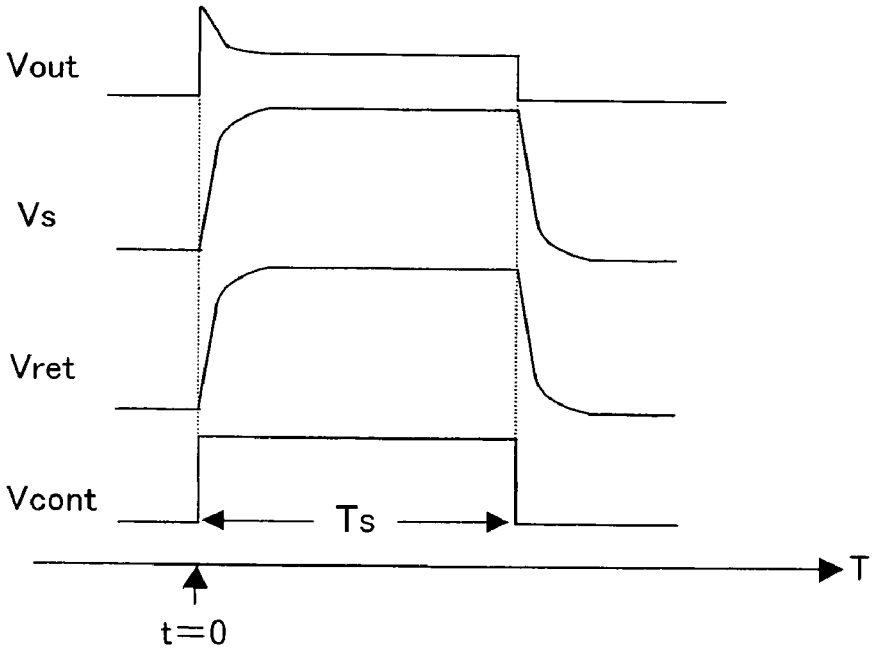
FIG. 2 is an operation waveform diagram of the device shown in FIG. 1.

FIG. 1 is a scanning electrode driving circuit diagram of a display device in the present invention, and FIG. 2 is an operation waveform diagram showing an operation of the device of FIG. 1.

In FIG. 1, a reference voltage source 4 is a reference voltage source which determines a scanning selection voltage. An output voltage of this reference voltage source 4 is inputted into a non-inverting input terminal of an amplifier 7 which is a scanning electrode potential correction circuit.

An output terminal of the amplifier 7 is connected to a scanning selection switch 2 having an on-resistance Ron1 as a scanning electrode potential detection circuit. When the scanning selection switch 2 is turned on, a scanning selection potential is applied to a scanning electrode. At this time, the electrode is brought into a selected state when a scanning electrode voltage reaches a predetermined voltage.

In FIG. 2, a switch control signal Vcont indicates a high level at time t=0, and the scanning selection switch 2 which is the scanning electrode potential detection circuit and a feedback switch 1 transit to an on-state. This time is regarded as a start time, a scanning selection period Ts starts from this time, and a light emitting operation starts.

A scanning electrode potential is returned to an inverting input terminal of the amplifier 7 via the feedback switch 1. A capacitance 3 (C2) associated with a feedback line is applied to the feedback switch 1.

Figure 3:
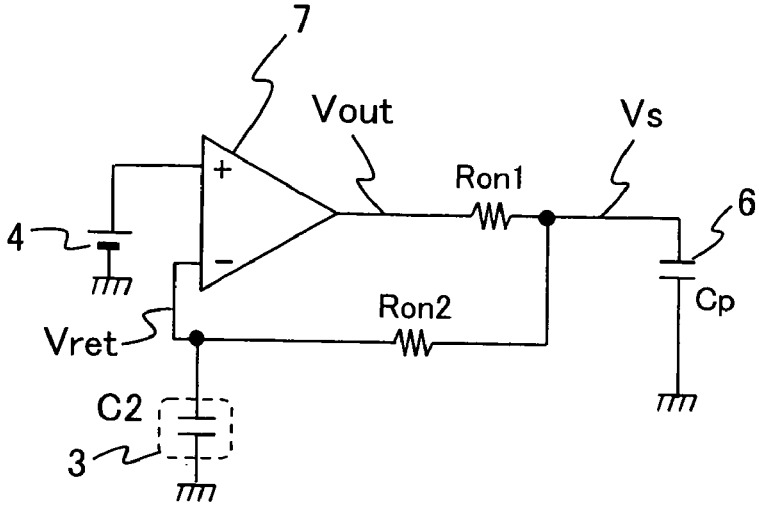
FIG. 3 is an equivalent circuit diagram of FIG. 1.
Figure 13:
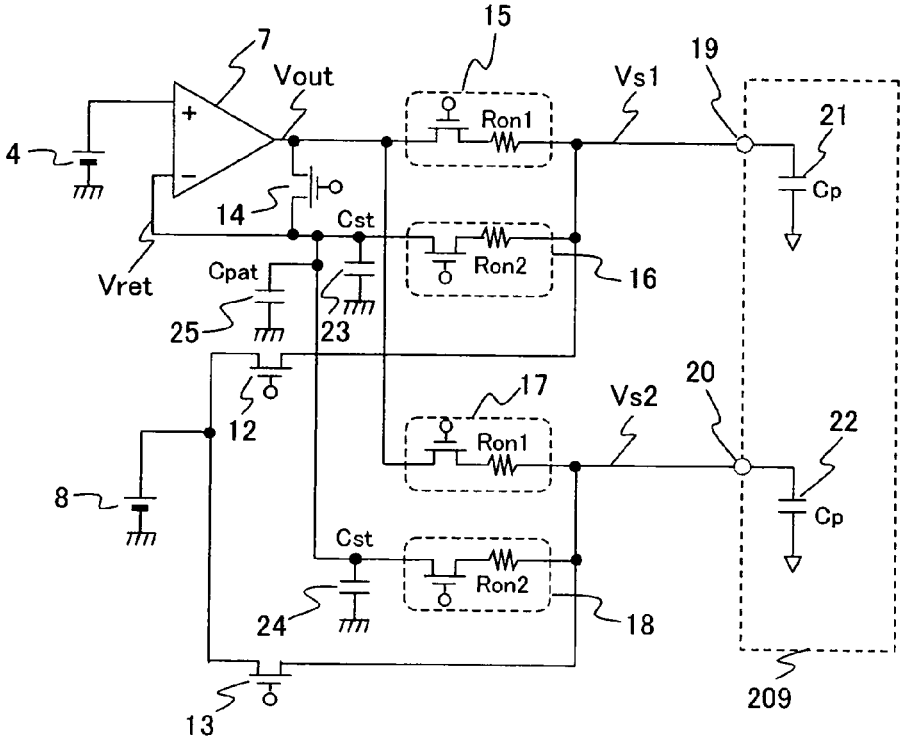
FIG. 13 is a scanning electrode driving circuit diagram of the circuit shown in FIG. 10.
Figure 14:
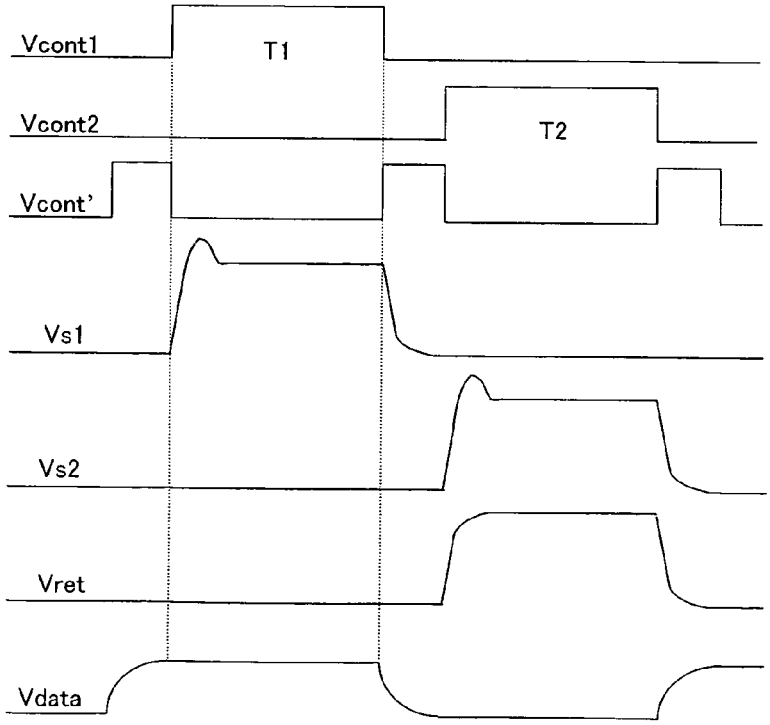
FIG. 14 is an operation waveform diagram of the circuit shown in FIG. 13.

FIG. 3 is an equivalent circuit diagram of the device shown in FIG. 1 in the selected state. The same constituting components as those of FIG. 1 are denoted with the same symbols. The capacitance 3 (C2) is a combined capacitance including a wiring line capacitance Cpat of the feedback line and a parasitic capacitance Cst of the feedback switch itself as shown in FIG. 13.

In FIG. 3, a relation between a voltage Vs applied to the scanning electrode and an inverting input terminal voltage Vret of the amplifier 7 is given by the following equation (1) by use of a transfer function using a complex frequency S.

$$Vret = \frac{1}{S \cdot C2 \cdot Ron2 + 1} Vs \tag{1}$$

The equation (1) means that an inverting input signal of the amplifier 7 is delayed largely behind the scanning electrode voltage Vs in a case where a primary delay element of the feedback line is large.

The amplifier 7 performs a negative feedback operation so that the inverting input terminal voltage becomes equal to a non-inverting input terminal voltage, but as a scanning electrode voltage, a voltage waveform including overshooting components is applied to the scanning electrode as described above.

Next, a relation between an output voltage Vout and the inverting input terminal voltage Vret of the amplifier 7 is given by the following equation (2) by use of the transfer function using the complex frequency S.

$$Vret = \frac{1}{S^2 Cp \cdot C2 \cdot Ron1 \cdot Ron2 + S(Cp + C2)Ron1 + 1} Vout \tag{2}$$

The equation (2) means that the amplifier is brought into an oscillated state with a reduced phase margin in a case where the primary delay element of the feedback line is large. Therefore, the delay elements of the equations (1) and (2) are set to conditions shown in the following equation (3) to thereby reduce the overshooting components and oscillations.

$$C2 \cdot \mathrm{Ron2} \ll Cp \cdot \mathrm{Ron1} \tag{3}$$

When conditions of a time constant shown in the equation (3) are satisfied, the equation (2) can be represented by the following equation (4).

$$Vret \approx \frac{1}{S \cdot Cp \cdot Ron1 + 1} Vout \tag{4}$$

The equation (4) indicates that a delay from the output voltage Vout to the inverting input terminal voltage Vret of the amplifier 7 is the primary delay element, and the overshooting components and the oscillations can be reduced. FIG. 2 shows the scanning electrode voltage Vs and the inverting input terminal voltage Vret of the amplifier 7 at this time.

It has been so far described that the on-resistance Ron1 or Ron2 exists in the scanning selection switch 2 or in the feedback switch 1. However, when a semiconductor switch is used, protection resistances are sometimes connected in series for a purpose of protection of this semiconductor switch or prevention of the oscillation. In this case, Ron1 or Ron2 described above is regarded as a combined resistance value including the on-resistance of the semiconductor switch and the protection resistance connected in series to the semiconductor switch, and the value may be set to a resistance value which satisfies the equation (4).

According to the present embodiment, in a case where the negative feedback amplifier is used in the scanning electrode driving circuit of a matrix type display using an electron emission element as an electron source, a stabilized operation of the negative feedback amplifier is secured, and the scanning electrode driving voltage can be realized without any overshooting component. Furthermore, it is possible to display a satisfactory image without any glay-scale error.

Embodiment 2

In Embodiment 2 of the present invention, there will be described a specific value of an on-resistance value of a feedback switch.

A capacitance 6 (Cp) described in Embodiment 1 is a capacitance component of one scanning wiring line. Here, a VGA panel (640 dots×RGB×480 lines) will be described as an example.

A capacitance value Cp of the capacitance 6 is determined by the number of pixels arranged in a horizontal direction. Assuming that one pixel capacitance is 20 pF, the capacitance value Cp is 38400 pF.

On the other hand, since a scanning selection switch current reaches several hundreds of milliamperes to several amperes, an on-resistance Ron1 of a scanning selection switch 2 is preferably set to a small on-resistance value of 1Ω or less. However, a realistic on-resistance in a case where a circuit is constituted of an LSI is set to several ohms to several tens of ohms from a viewpoint of a chip size. Here, when the on-resistance value of the scanning selection switch 2 is set to 10Ω, a time constant τ1 of the switch indicates 0.38 μS.

On the other hand, since an input impedance of an amplifier 7 is infinitely large, a current hardly flows through a feedback switch 1. Therefore, an on-resistance Ron2 of a conventional feedback switch 1 can be set to a large value to a certain degree, and a capacitance of one feedback switch can be set to a small capacitance of 1 pF or less.

However, as viewed from one feedback switch which performs a feedback operation as in the present embodiment, a capacitance component of another feedback switch is connected, and this results in generation of a primary delay element.

Here, assuming that the feedback switch capacitance is 0.5 pF, a total combined capacitance reaches 240 pF. It is to be noted that a wiring line capacitance of a feedback line is 50 pF.

Equation (3) shows conditions for preventing the generation of the primary delay element in the feedback line. From the equation (3), the on-resistance value Ron2 of the feedback switch 1 is represented by the following equation (5).

$$Ron2 << \frac{Cp \cdot Ron1}{C2} \tag{5}$$

Here, the on-resistance value Ron2 of the feedback switch 1 having less primary delay elements is calculated using the above-mentioned specific resistance value and capacitance value. The conditions of the on-resistance Ron2 are that the equation (5) be applied, and the value is sufficiently smaller than about 1.3 kΩ. The on-resistance value of the feedback switch is set to 1/10 of the value, that is, 130Ω. This resistance value is sufficiently larger than that of the scanning selection switch 2, which is 10Ω.

According to Embodiment 2, in the same manner as in Embodiment 1, in a case where a negative feedback amplifier is used in a scanning electrode driving circuit of a matrix type display using an electron emission element as an electron source, a stabilized operation of the negative feedback amplifier is secured, and a scanning electrode driving voltage can be realized without any overshooting component. Furthermore, in a case of LSI implementation, it is possible to constitute a scanning electrode driving circuit whose costs have been reduced.

Embodiment 3

In Embodiment 3 of the present invention, there will be described sizes of a scanning selection switch and a feedback switch in an LSI.

Figure 4:
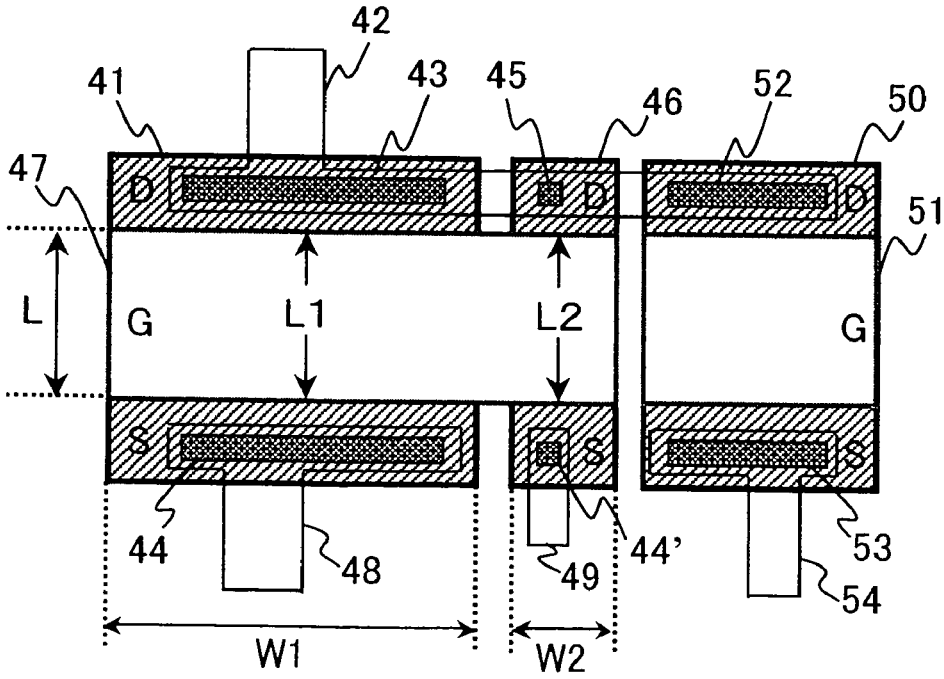
FIG. 4 is an arrangement diagram of a unit package of switches 1, 2, and 9 shown in FIG. 1.

FIG. 4 is a plan view of a scanning selection switch 41 and a feedback switch 46 arranged on an LSI chip, and also shows a plan view of a non-selection switch 50. As each switch, an MOS transistor is used.

The scanning selection switch 41 has a channel width W1 and a channel length L1. On the other hand, the feedback switch 46 has a channel width W2 and a channel length L2. It is to be noted that here L=L1=L2 is set, but the length L1 may be different from L2.

The scanning selection switch 41 and the feedback switch 46 are constituted of a common gate electrode 47 because both of the switches are turned on in a scanning selection period. It is to be noted that to turn off the non-selection switch 50 at a time when the above switches are turned on, a gate electrode 51 of the non-selection switch is separately constituted, but there may be used, as the switch 50, an MOS transistor having characteristics opposite to those of the switches 41, 46, so that the gate electrodes 47, 51 may be constituted of a common gate electrode.

Drain electrodes of the scanning selection switch 41, the feedback switch 46, and the non-selection switch 50 are connected to contact holes 43, 45, and 52 by a metal wiring line 42. The metal wiring line 42 is connected to a scanning electrode of a display panel.

In the scanning selection period, the scanning selection switch 41 is brought into an on-state, and a scanning electrode driving voltage is applied to one of scanning wiring lines of the display panel. Moreover, the feedback switch 46 is also brought into the on-state, and a scanning electrode potential is returned to an inverting input terminal of the amplifier 7 shown in FIG. 1.

In FIG. 4, a source electrode of the scanning selection switch 41 is connected to the output terminal of the amplifier 7 shown in FIG. 1 by use of a contact hole 44 and a metal wiring line 48. A source electrode of the feedback switch 46 is connected to the inverting input terminal of the amplifier 7 shown in FIG. 1 by use of a contact hole 44' and a metal wiring line 49. It is to be noted that a source electrode of the non-selection switch 50 is connected to a non-selection reference voltage source 8 shown in FIG. 1 by use of a contact hole 53 and a metal wiring line 54.

On-resistance values of these switches 41, 46 are proportional to the channel lengths, and inversely proportional to the channel widths. Assuming that the switches 41, 46 have an equal channel length, an on-resistance value of the scanning selection switch 41 is Ron1, and an on-resistance value of the feedback switch 46 is Ron2, a ratio between Ron1 and Ron2 can be defined by the following equation (6).

$$\frac{Ron1}{Ron2} = \frac{L1}{W1} \Big/ \frac{L2}{W2} = \frac{L}{W1} \Big/ \frac{L}{W2} = \frac{W2}{W1} \tag{6}$$

When a channel width ratio between the feedback switch 46 and the scanning selection switch 41 is calculated with respect to an on-resistance value calculated in Embodiment 2, there is obtained W2/W1=0.077. This indicates that an occupying area of the feedback switch 46 is smaller than that of the scanning selection switch 41. That is, L2/W2>L1/W1.

According to the present embodiment, in the same manner as in Embodiment 2, in a case where a negative feedback amplifier is used in a scanning electrode driving circuit of a matrix type display using an electron emission element as an electron source, a stabilized operation of the negative feedback amplifier is secured, and a scanning electrode driving voltage can be realized without any overshooting component. Furthermore, it is possible to constitute a scanning electrode driving circuit whose costs have been reduced in a case of LSI implementation.

Embodiment 4

Figure 5:
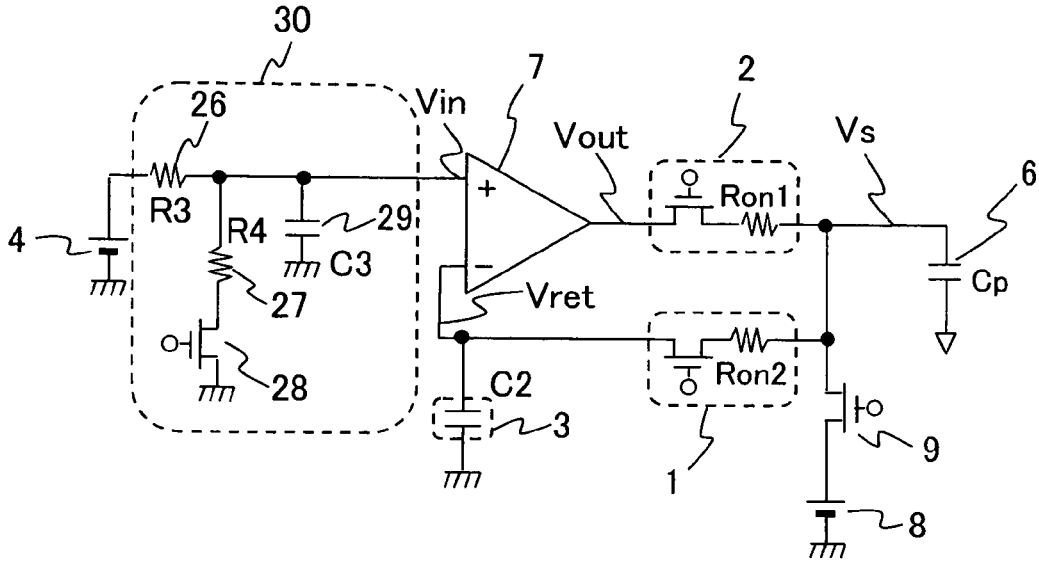
FIG. 5 is a scanning electrode driving circuit diagram of another display device according to the present invention.
Figure 6:
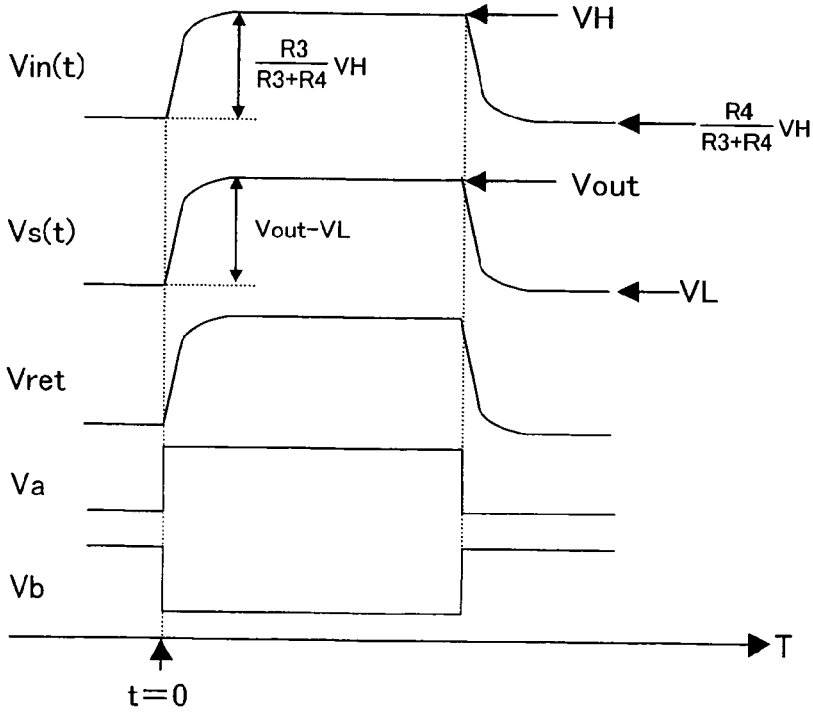
FIG. 6 is an operation waveform diagram of the device shown in FIG. 5.

Embodiment 4 of the present invention will be described hereinafter with reference to FIGS. 5 and 6. FIG. 5 is a circuit diagram of the present embodiment, and FIG. 6 is an operation waveform diagram showing an operation of the circuit shown in FIG. 5.

FIG. 5 shows a circuit constitution using a technology of gradually raising an input voltage of an amplifier 7 to reduce overshooting components of a scanning electrode voltage in addition to Embodiment 1.

In FIG. 5, an output of a reference voltage source 4 is connected to a resistance 26 having a resistance value R3, and a capacitor 29 having a capacitance value C3 is connected between one end of this resistance 26 and GND.

A resistance 27 having a resistance value R4 is connected to a connection point between the resistance 26 and the capacitor 29, and a switch 28 is connected in series to the resistance 27, and connected to the GND. These resistances 26, 27, the switch 28, and the capacitor 29 constitute a reference voltage correction circuit 30.

The switch 28 is driven by a switch control signal Vb, and brought into an on-state at a high level. The switch 28 is brought into the on-state at time t<0 in a non-selection period, and the switch 28 is brought into an off-state at a time t≧0 in a scanning selection period.

Therefore, a plus (positive) side voltage of the capacitor 29, that is, a non-inverting input terminal voltage Vin of the amplifier 7 is a direct-current voltage determined by a voltage dividing ratio between the resistance 26 and the resistance 27 in the non-selection period, a waveform involves a time constant of the resistance 26 and the capacitor 29 in the beginning of the scanning selection period, and a reference voltage VH of the reference voltage source 4 is finally reached.

FIG. 6 shows a non-inverting input terminal voltage Vin(t) of the amplifier 7. Furthermore, the non-inverting input terminal voltage Vin(t) is given by the following equations (7) and (8).

$$Vin(t) = \frac{R4}{R3 + R4} VH \quad t < 0 \tag{7}$$

-continued $$Vin(t) = VH - VH\left(\frac{R3}{R3 + R4}\right)\exp\left(-\frac{1}{R3 \cdot C3} \cdot t\right) \quad t \geqq 0 \tag{8}$$

A scanning selection switch 2 and a feedback switch 1 are driven by a switch control signal Va, and brought into an on-state at a high level. At time t<0, the scanning selection switch 2 and the feedback switch 1 are brought into an off-state in a non-selection period.

At a scanning selection period time t≧0, the scanning selection switch 2 and the feedback switch 1 shift to the on-state. At this time, a scanning selection potential is supplied from the amplifier 7 to a scanning electrode via the scanning selection switch 2.

Furthermore, the feedback switch 1 is brought into the on-state, and the scanning electrode potential is returned to an inverting input terminal of the amplifier 7 via the feedback switch 1. The above-described negative feedback operation allows a scanning electrode potential Vs(t) to have the same waveform as that of the non-inverting input terminal voltage Vin(t) of the amplifier 7.

On the other hand, in a case where an on-resistance value of each switch and each capacitance value are set so as to satisfy conditions of Ron1·Cp>>Ron2·C2 described in Embodiment 1, the scanning electrode potential Vs(t) is obtained as a time function by the following equations (9) and (10):

$$Vs(t) = VL \quad t < 0 \tag{9}$$

$$Vs(t) = Vout - (Vout - VL)\exp\left(-\frac{1}{Ron1 \cdot Cp} \cdot t\right) \quad t \geqq 0 \tag{10}$$

Here, the equation (10) performs approximation wherein an output voltage Vout of the amplifier 7 is regarded as a step function having an amplitude of the scanning selection voltage VH, and conditions for Vs(t)=Vin(t) are derived from the equations (8) and (10), thereby obtaining the following equations (11) and (12).

$$\frac{VL}{VH} = \frac{R4}{R3 + R4} \tag{11}$$

$$Ron1 \cdot Cp = R3 \cdot C3 \tag{12}$$

Assuming that a non-selection voltage is VL=5 V, and a scanning selection voltage is VH=10 V, C3=1000 pF, R3=384Ω, and R4=384Ω are obtained as a capacitance value and resistance values in a case where numerical values described in Embodiment 2 are applied to the equations (11) and (12).

According to the present embodiment, needless to say, a scanning electrode voltage can be realized without any overshooting components, and it is possible to display a satisfactory image without any pedestal level error or gray-scale error. Furthermore, a greater overshooting component reducing effect is obtained as compared with Embodiment 1.

Embodiment 5

Figure 7:
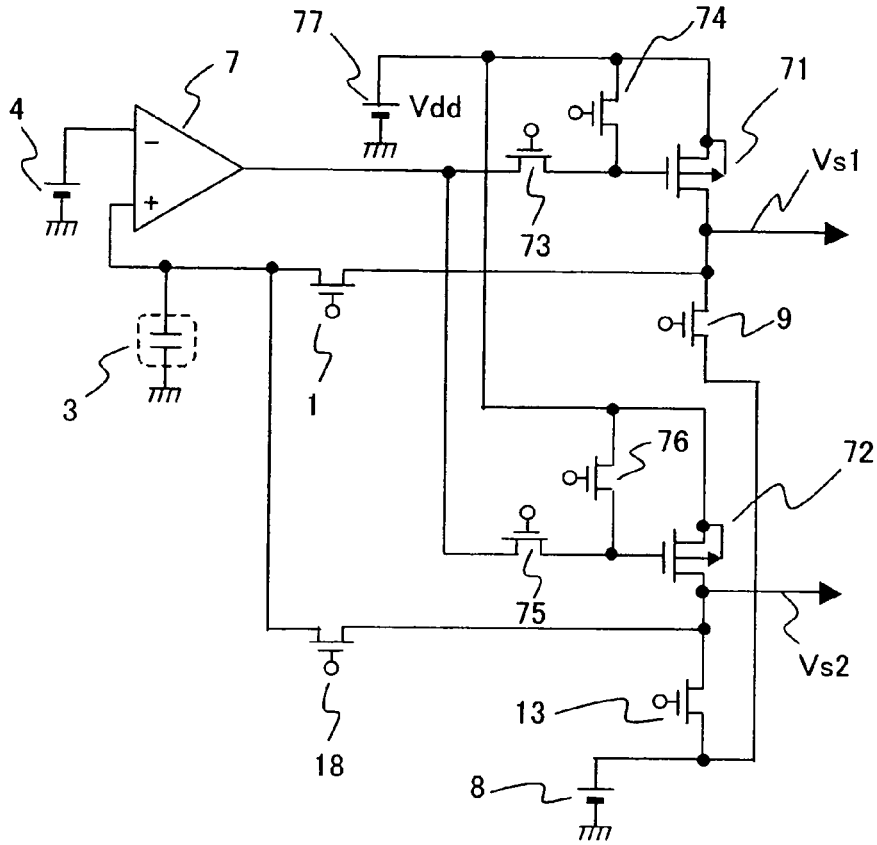
FIG. 7 is a scanning electrode driving circuit diagram of another display device according to the present invention.
Figure 8:
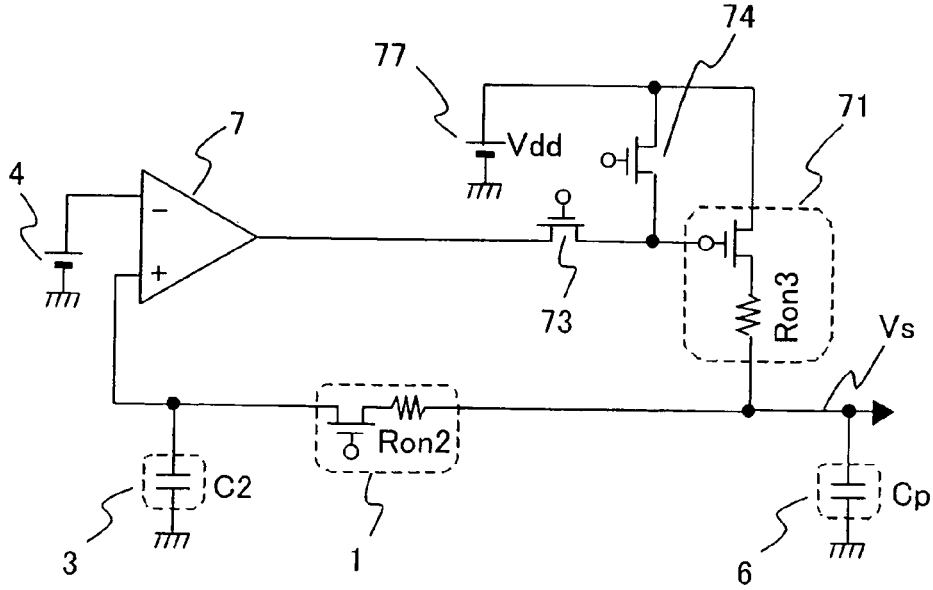
FIG. 8 is an equivalent circuit diagram of FIG. 7.
Figure 9:
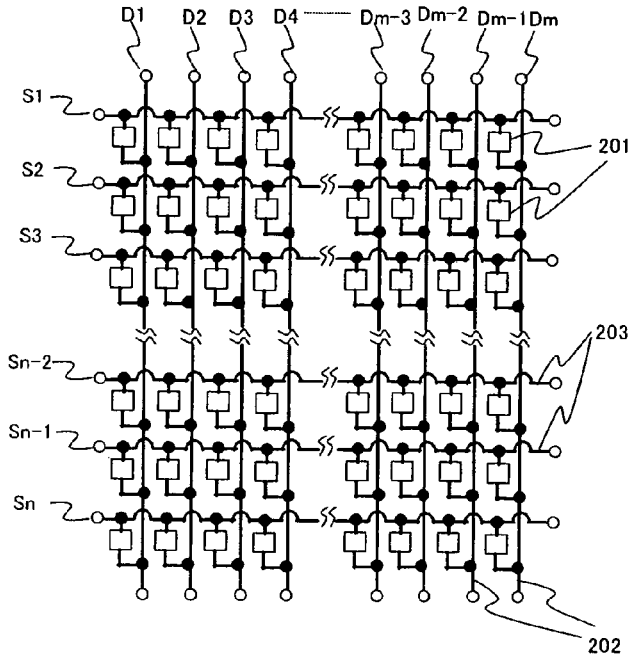
FIG. 9 is a structure diagram of a display panel in which electron emission elements are arranged in a matrix form.
Figure 10:
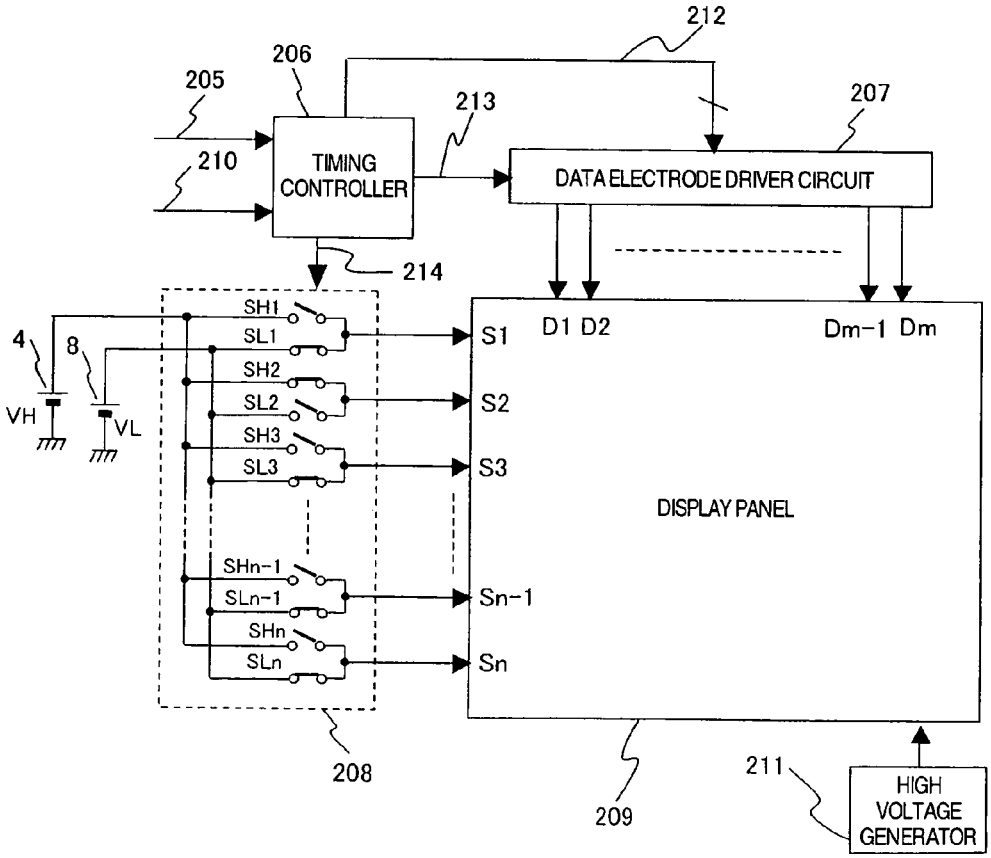
FIG. 10 is a driving circuit diagram for driving the display panel shown in FIG. 9.
Figure 11:
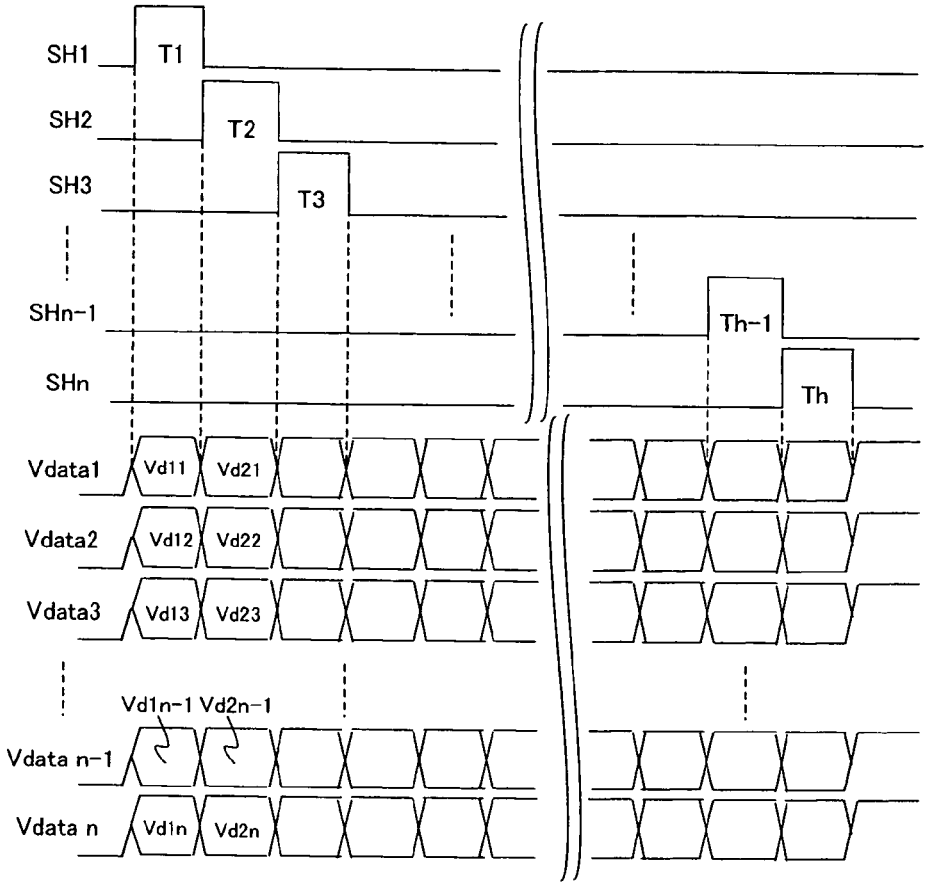
FIG. 11 is an operation waveform diagram of the circuit shown in FIG. 10.
Figure 12:
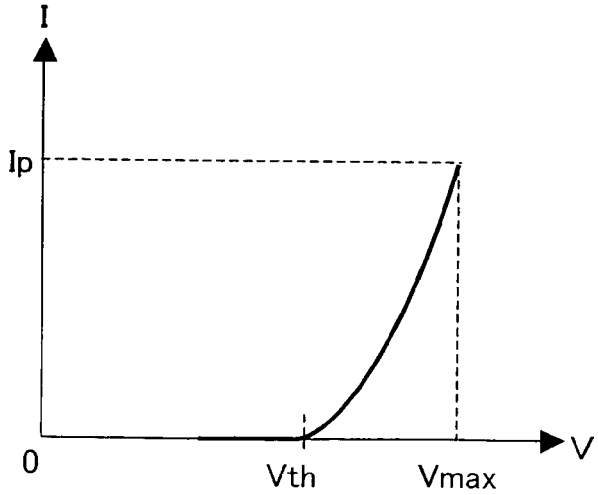
FIG. 12 is a voltage-current characteristic diagram of a thin-film electron source shown in FIG. 9.

There will be described hereinafter Embodiment 5 of the present invention with reference to FIGS. 7 and 8. FIG. 7 is a circuit constitution diagram of the present embodiment, and FIG. 8 is an equivalent circuit diagram of FIG. 7.

To facilitate description, FIG. 7 shows a circuit which drives two of a plurality of scanning wiring lines. In FIG. 7, Vs1 and Vs2 are connected to the scanning wiring lines. As output elements 71 and 72 which drive the scanning wiring lines, a P-channel MOSFET is used. Gate terminals of the output elements 71 and 72 are controlled by a control potential from the amplifier 7, and a voltage to be applied to each scanning wiring line is stabilized. The reference voltage source 4 is a voltage source which determines a scanning selection voltage, and the voltage is inputted into an inverting input terminal of the amplifier 7.

When the scanning selection voltage is to be outputted to Vs1, a selection switch 73 is turned on which selects a control potential from the amplifier 7, and a feedback switch 1 is turned on. Furthermore, an electric discharging switch 74 and a non-selection switch 9 are turned off. In a circuit block to select the next scanning wiring line, a selection switch 75 is turned off which selects a control potential from the amplifier 7, and a feedback switch 18 is turned off. Furthermore, an electric discharging switch 76 and a non-selection switch 13 are turned on.

These electric discharging switches 74 and 76 are turned on at a time when the scanning wiring line is changed from a selected state to a non-selected state, and the switches discharge electric charges accumulated in a capacitance between a gate and a source of the output element 71 or 72 to thereby prevent a current from being passed through the output element 71 or 72. Thus, the output element 71 or 72 can be securely turned off without being broken.

A source of the output element 71 which drives the scanning wiring line is connected to a power supply 77 (Vdd). An amplifier 7 controls a gate voltage of the output element 71 to thereby change a current flowing from the power supply 77 (Vdd) to the scanning wiring line. A negative feedback operation is performed so that a drain terminal Vs1 of the output element 71 is returned to a non-inverting input terminal of the amplifier 7 via a feedback switch 1, and Vs1 indicates a potential equal to that of a reference voltage source 4.

Next, when the scanning selection voltage is to be outputted to Vs2, in order to turn off the output element 71 which has driven the previous scanning line, the selection switch 73 and the feedback switch 1 are changed from an on-state to an off-state. Furthermore, the electric discharging switch 74 and the non-selection switch 9 are changed from an off-state to an on-state. Moreover, the selection switch 75 for driving the output element 72 is changed from an off-state to an on-state, and the feedback switch 18 is changed from an off-state to an on-state. Furthermore, the electric discharging switch 76 and the non-selection switch 13 are changed from an on-state to an off-state.

As described above, the negative feedback operation is performed so that the states of the switches 1, 9, 73, and 74 and the switches 13, 18, 75, and 76 are reversed as described above, the gate terminal of the output element 72 is driven by the amplifier 7, and Vs2 indicates a potential equal to that of the reference voltage source 4.

FIG. 8 is an equivalent circuit diagram of a block brought into the selected state in FIG. 7. The output element 71 is constituted of an on-resistance Ron3 and a switch, and the feedback switch 1 is constituted of an on-resistance Ron2 and a switch. A drain terminal of the output element 71 is connected to a panel capacitance load 6 (Cp). Furthermore, a capacitance 3 (C2) is a combined capacitance including a wiring line capacitance of a feedback line and a parasitic capacitance of the feedback switch itself. A current for driving the scanning wiring line is supplied from the power supply 77 (Vdd).

A relation between the non-inverting input terminal voltage Vret of the amplifier 7 and the power supply 77 (Vdd) can be obtained to thereby check stability of a negative feedback loop. A relation between the power supply 77 (Vdd) to the non-inverting input terminal voltage Vret is given by the following equation (13) by use of a transfer function using a complex frequency S.

$$Vret = \frac{1}{S^2 Cp \cdot C2 \cdot Ron2 \cdot Ron3 + S(Cp + C2)Ron3 + 1} Vdd \tag{13}$$

The equation (13) is an equation including a secondary delay element, and means that a phase margin is decreased, and overshooting components or oscillations are generated in a case where a primary delay element of the feedback line is large. Therefore, when the primary delay element of the feedback line is reduced, and conditions of the following equation (14) are set, the equation (13) can be represented by equation (15).

$$C2 \cdot Ron2 << Cp \cdot Ron3 \tag{14}$$

$$Vret \approx \frac{1}{S \cdot Cp \cdot Ron3 + 1} Vdd \tag{15}$$

The equation (15) means that a delay between the power supply 77 (Vdd) and the non-inverting input terminal voltage Vret is the primary delay element, and the overshooting components and oscillations can be reduced.

According to the present embodiment, in the same manner as in Embodiment 1, needless to say, in a case where a negative feedback amplifier is used in a scanning electrode driving circuit of a matrix type display using electron emission elements as electron sources, a negative feedback operation is stabilized, and the scanning electrode driving voltage can be realized without any overshooting component. Furthermore, since the negative feedback amplifier only drives a control terminal of the output element, the amplifier can be constituted of a negative feedback amplifier having a small driving capability, and it is possible to realize the scanning electrode driving circuit whose costs have been reduced as compared with Embodiment 1.

As described above, in the system in which the electron emission elements are arranged in a matrix form, a technology of correcting luminance unevenness attributable to a finite impedance of the driving circuit is essential. When the present invention is applied to the matrix type system, a high-precision stabilized display panel driving waveform is obtained, and it is therefore possible to display a excellent image.

Moreover, the present invention has been described in accordance with a thin-film electron source as an example, but needless to say, the present invention is effective even in a display device using other cathode elements such as a field emission type cathode element or a carbon nano-tube cathode element.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A display device comprising:

a display panel including a plurality of scanning wiring lines, a plurality of data wiring lines intersecting with the scanning wiring lines, a plurality of electron emission elements connected to both of the wiring lines, and phosphors which emits light by electrons from the electron emission elements;

scanning wiring line drivers connected to the scanning wiring lines;

data wiring line drivers connected to the data wiring lines; and an irradiation circuit for converging the electrons from the electron emission elements to irradiate the phosphors with the electrons, a scanning wiring line driver comprising:

a detection circuit including a selection switch which brings the scanning wiring line into a selected state, a non-selection switch which brings the scanning wiring line into a non-selected state, and a feedback switch which detects a potential of each scanning wiring line; and a correction circuit which corrects the scanning wiring line potential into a predetermined potential every scanning wiring line based on the scanning wiring line potential detected by the feedback switch, the detection circuit including a capacitance of the feedback switch and a wiring line capacitance, wherein a time constant formed of an on-resistance value of the feedback switch, the capacitance of the feedback switch, and the wiring line capacitance is smaller than a time constant formed of an on-resistance value of the selection switch and a capacitance of the display panel.

2. The display device according to claim 1, wherein the on-resistance value of the feedback switch is larger than that of the selection switch.

3. The display device according to claim 1, wherein the detection circuit includes a first protection resistance connected in series to the selection switch, and a second protection resistance connected in series to the feedback switch, and a time constant formed of a combined resistance value including a resistance value of the feedback switch and a second protection resistance value and the capacitance of the feedback switch and the wiring line capacitance is smaller than a time constant formed of a combined resistance value including a resistance value of the selection switch and a first protection resistance value and the capacitance of the display panel.

4. The display device according to claim 3, wherein the combined resistance value including the resistance value of the feedback switch and the second protection resistance value is larger than a combined resistance value including the resistance value of the selection switch and the first protection resistance value.

5. The display device according to claim 1, wherein the selection switch and the feedback switch are semiconductor switches, the selection switch has a channel length L1 and a channel width W1;

the feedback switch has a channel length L2 and a channel width W2;

and a ratio L2/W2 between the channel length and the channel width is larger than a ratio L1/W1.

6. The display device according to claim 1, wherein the selection switch, the feedback switch, and the non-selection switch constituted one set, and a plurality of the one set are constituted of one semiconductor integrated circuit.

7. The display device according to claim 1, wherein the correction circuit corrects the scanning wiring line potential into a predetermined potential every scanning wiring line based on the scanning wiring line potential detected by the feedback switch and a reference voltage, and the reference voltage is gradually raised by the correction circuit.

8. A display device comprising:

a display panel including a plurality of scanning wiring lines, a plurality of data wiring lines intersecting with the scanning wiring lines, a plurality of electron emission elements connected to both of the wiring lines, and phosphors which emit light by electrons from the electron emission elements;

scanning wiring line drivers connected to the scanning wiring lines;

data wiring line drivers connected to the data wiring lines; and an irradiation circuit for converging the electrons from the electron emission elements to irradiate the phosphors with the electrons, a scanning wiring line driver comprising:

a detection circuit including an output element which drives the scanning wiring line, a selection switch which selects a control potential to be applied to the output element, a non-selection switch which brings the scanning wiring line into a non-selected state, and a feedback switch which detects a potential of each scanning wiring line; and a correction circuit which corrects the scanning wiring line potential into a predetermined potential every scanning wiring line based on the scanning wiring line potential detected by the feedback switch, the detection circuit including a capacitance of the feedback switch and a wiring line capacitance, wherein a time constant formed of an on-resistance value of the feedback switch and the capacitance of the feedback switch and the wiring line capacitance is smaller than a time constant formed of an on-resistance value of the output element and a capacitance of the display panel.

9. The display device according to claim 8, wherein the on-resistance value of the feedback switch is larger than the resistance value of the output element.

10. A method of driving a display device having a display panel including a plurality of scanning wiring lines, a plurality of data wiring lines intersecting with the scanning wiring lines, a plurality of electron emission elements connected to both of the wiring lines, and phosphors which emit light by electrons from the electron emission elements; scanning wiring line drivers connected to the scanning wiring lines; data wiring line drivers connected to the data wiring lines; and an irradiation circuit for converging the electrons from the electron emission elements to irradiate the phosphors with the electrons, the method comprising the steps of:

bringing a scanning wiring line to be selected into a selected state by use of a selection switch;

bringing a scanning wiring line not to be selected into a non-selected state by use of a non-selection switch;

detecting a potential of the selected scanning wiring line; and correcting the scanning wiring line potential into a predetermined potential every scanning wiring line based on the detected scanning wiring line potential, wherein a time constant formed of a combined capacitance including a capacitance of the feedback switch and a wiring line capacitance and an on-resistance value of the feedback switch, is smaller than a time constant formed of an on-resistance value of the selection switch and a capacitance of the display panel.

* * * * *